US011488733B2

(12) United States Patent
Bezlepkin et al.

(10) Patent No.: US 11,488,733 B2
(45) Date of Patent: Nov. 1, 2022

(54) METHOD AND SYSTEM FOR BRINGING A NUCLEAR POWER PLANT INTO A SAFE STATE AFTER EXTREME EFFECT

(71) Applicants: Joint-stock company Scientific Research and Design Institute for Energy Technologies ATOMPROEKT, g. Sankt-Petersburg (RU); JOINT STOCK COMPANY "SCIENCE AND INNOVATIONS", Moscow (RU)

(72) Inventors: Vladimir Viktorovich Bezlepkin, g. Sankt-Peterburg (RU); Maksim Vladimirovich Gavrilov, pos. Murino (RU); Evgenij Aleksandrovich Tretyakov, g. Sankt-Peterburg (RU); Vyacheslav Borisovich Kozlov, g. Sankt-Peterburg (RU); Evgenij Pavlovich Obrazcov, g. Sankt-Peterburg (RU); Evgenij Igorevich Mezenin, g. Sankt-Peterburg (RU); Anton Eduardovich Shirvanyanc, g. Sosnovyj bor (RU); Darya Robertovna Altbregen, g. Sankt-Peterburg (RU); Lajne Vyajnovna Nosankova, g. Sankt-Peterburg (RU); Evgenij Yurevich Egorov, g.Volgodonsk (RU); Anzhela Vasilevna Lukina, g. Sankt-Peterburg (RU); Dmitrij Yakovlevich Vibe, g. Sankt-Peterburg (RU)

(73) Assignees: JOINT-STOCK COMPANY SCIENTIFIC RESEARCH AND DESIGN INSTITUTE FOR ENERGY TECHNOLOGIES ATOMPROEKT, G. Sankt-Petersburg (RU); JOINT STOCK COMPANY "SCIENCE AND INNOVATIONS", Moscow (RU)

( * ) Notice: Subject to any disclaimer, the term of this patent is extended or adjusted under 35 U.S.C. 154(b) by 0 days.

(21) Appl. No.: 16/627,734

(22) PCT Filed: Dec. 28, 2018

(86) PCT No.: PCT/RU2018/000895

§ 371 (c)(1),
(2) Date: Dec. 30, 2019

(87) PCT Pub. No.: WO2020/067918

PCT Pub. Date: Apr. 2, 2020

(65) Prior Publication Data

US 2021/0335511 A1 Oct. 28, 2021

(30) Foreign Application Priority Data

Sep. 28, 2018 (RU) ..... RU2018134285

(51) Int. Cl.
*G21C 15/18* (2006.01)
*G21C 15/24* (2006.01)
(Continued)

(52) U.S. Cl.
CPC ..... *G21C 15/18* (2013.01); *G21C 15/182* (2013.01); *G21C 15/24* (2013.01); *G21C 15/253* (2013.01); *G21D 3/04* (2013.01)

(58) Field of Classification Search
CPC ..... G21C 15/18; G21C 15/253; G21C 15/24; G21C 15/182
(Continued)

(56) References Cited

U.S. PATENT DOCUMENTS 4,830,815 A * 5/1989 Gluntz ..... G21C 15/18 376/298
5,309,487 A * 5/1994 McDermott ..... G21D 3/04 376/250
(Continued)

FOREIGN PATENT DOCUMENTS

KR 101734326 B1 * 5/2017 ..... G21C 19/08
RU 95117882 A 10/1997
(Continued)

*Primary Examiner* — Darlene M Ritchie
(74) *Attorney, Agent, or Firm* — J. Miguel Hernandez; James R. Gourley; Carstens, Allen & Gourley, LLP

(57) ABSTRACT

The method and system for bringing a nuclear power plant to a safe state after extreme effect reduce the temperature of the coolant after extreme effect. The system includes inlet and outlet pipelines, a steam generator, a storage tank and a
(Continued)

heat exchanger, a separation tank above the steam generator and connected by two pipelines to a storage tank, a pump, a control unit. The method involves filling the system with coolant, feeding the coolant from the steam generator through the inlet pipeline and the storage tank to the heat exchanger, and feeding the coolant through the outlet pipeline back to the steam generator, wherein the pump is turned on for feeding the coolant and subsequent operation of the system. The first air valve is used to maintain pressure in the system, ensuring the absence of boiling of the coolant.

5 Claims, 1 Drawing Sheet

(51) Int. Cl.
*G21C 15/253* (2006.01)
*G21D 3/04* (2006.01)

(58) Field of Classification Search
USPC ..... 376/281–282, 298–299
See application file for complete search history.

(56) References Cited

U.S. PATENT DOCUMENTS

| | | | | | |
|---|---|---|---|---|---|
| 5,414,743 | A * | 5/1995 | Batheja | G21C 15/18 | 376/277 |
| 5,887,043 | A * | 3/1999 | Spinks | G21C 15/18 | 376/298 |
| 6,069,930 | A * | 5/2000 | Gamble | G21C 15/18 | 376/282 |
| 2011/0158371 | A1* | 6/2011 | Sato | G21C 9/004 | 376/249 |
| 2017/0148533 | A1* | 5/2017 | Kim | G21C 15/18 | |
| 2017/0211804 | A1* | 7/2017 | Bezlepkin | F22D 1/50 | |
| 2018/0233240 | A1* | 8/2018 | Kim | G21C 9/012 | |

FOREIGN PATENT DOCUMENTS

| | | | |
|---|---|---|---|
| RU | 2107344 | C1 | 3/1998 |
| RU | 96283 | U1 | 7/2010 |
| RU | 111336 | U1 | 12/2011 |
| RU | 2646859 | C2 | 3/2018 |

* cited by examiner

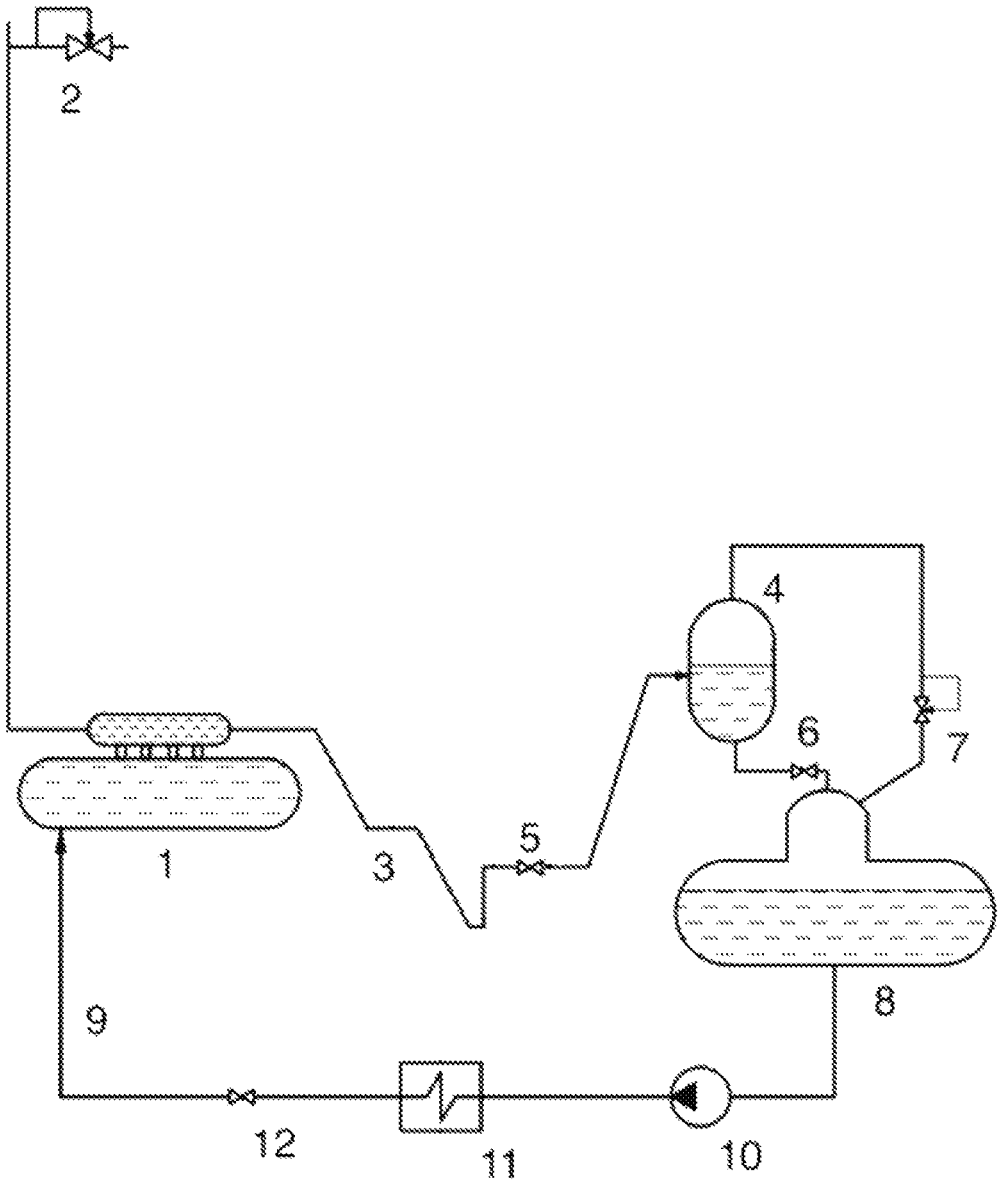
2
4
6
7
1
3
5
8
9
12
11
10

METHOD AND SYSTEM FOR BRINGING A NUCLEAR POWER PLANT INTO A SAFE STATE AFTER EXTREME EFFECT

CROSS-REFERENCE TO RELATED APPLICATIONS

This application is a US 371 application from PCT/RU2018/000895 filed Dec. 28, 2018, which claims priority to Russian Application No. 2018134285 filed Sep. 28, 2018, the technical disclosures of which are hereby incorporated herein by reference.

FIELD OF THE INVENTION

The group of inventions relates to the field of safe operation of nuclear power plants (NPPs), in particular, to methods and systems for emergency heat removal from nuclear power facilities.

BACKGROUND OF THE INVENTION

An important problem of nuclear energy is the removal of heat from a nuclear reactor after a serious accident. It is well-known that after a reactor shutdown, heat removal from a nuclear power facility is required for a considerable amount of time. Standard sprinkler-type cooling systems can be used for such heat removal, however, under extreme effect, for example, when an aircraft falls on a safety building where such systems are located, their operation may be impaired. In order to avoid a catastrophic development of events, in such cases there are used systems organized by the principle of passive heat removal, i.e. they work automatically when all NPP support systems are turned off due to steam energy, which condenses in heat exchangers, giving off heat, and returns back in the form of chilled water.

There are known systems of passive heat removal from the steam generator (SG SPHR), wherein a sectional heat exchanger connected with the steam generator, inlet and outlet pipelines, is located above the steam generator. During SG SPHR operation, steam is transferred from the steam generator to the heat exchanger through the inlet pipeline, there it gives off heat, condenses, after which the water formed flows through the outlet pipeline back to the steam generator. However, such systems can reduce the temperature of the coolant only to a certain value corresponding to the boiling point of water under appropriate conditions, i.e. about 110-130° C., because they use cooling by condensation of steam. Meanwhile, at present, increased demands are placed on heat removal systems, implying that the water in these systems must be brought to a temperature of 70° C., which will allow access to the reactor by raising its cover without fear of boiling saturated water with a temperature of 130° C. with sudden pressure drop and, as a result, thermal explosions. Thus, when using, for example, a passive heat removal system, it is necessary to additionally cool the water circulating in the primary system and having a temperature of about 130° C., up to 70° C., after operation of the SG SPHR system. Since until the water temperature in SG SPHR is reduced to 130° C., about 72 hours elapse from the onset of the emergency, it becomes possible to rely on the restoration of power supply and, thus, use active heat removal systems using pumps, valves, etc. To do this, the secondary coolant circulation system with a water-water energetic reactor (WWER) and feed water connected to it can be used. However, there are problems associated with the difference in the temperature of the feed water and steam in the steam generator, as well as with the existing piping arrangement, which in some areas has a negative slope, which can lead to blockages and hydraulic impacts, which, in turn, can destroy system pipelines. The present group of inventions is aimed at solving this problem.

Various emergency heat removal systems are known that are designed to remove heat from a steam generator.

There is a known power installation (application of the Russian Federation for invention No. 95117882, publ. 10 Oct. 1997), comprising a water-water reactor with circulation pipelines for hot and cooled coolant, connected on the slope to the steam generator, a system for passive heat removal from the steam generator and a pumped-storage tank with inlet and drain branch pipes, the last of which is in communication with the water-water reactor, while the free end of the inlet branch pipe of the pumped-storage tank is in communication with the pipeline for the cooled coolant in the zone of connecting it with the steam generator.

There is also a known system of gas removal from the main circulation pump of the water-water reactor facility (patent of the Russian Federation for the invention No. 2107344, publ. 20 Mar. 1998), which includes a reactor, an active zone, main circulation pipelines, a pressure compensator with water and steam spaces, a steam generator with "hot" and "cold" vertical collecting headers, a pipeline for gas removal from a "cold" vertical collecting header with isolating valves installed on the gas removal pipeline, the main circulation pump to which in the upper part, a gas removal pipeline is connected, a gas removal pipeline from the upper part of the main circulation pump is connected to a gas removal pipeline from a "cold" vertical collecting header to isolating valves.

There is a known system for emergency heat removal (patent of the Russian Federation for the invention No. 2646859, publ. 19 Feb. 2018), comprising a heat exchanger-heater and a heat exchanger-cooler, connected to each other by the riser and downcomer legs, a tank with water inventory, connected by a pipeline to the downcomer leg, and there is also a tank for collecting non-condensable gases, which is connected to the downcomer leg between the heat exchanger-cooler and the tank with the water inventory, wherein, a check valve is installed between the tank with the water inventory and the tank for collecting non-condensable gases, and controlled valves are installed between the latter and the heat exchanger-cooler.

There is a known system of passive heat removal through a steam generator (patent of the Russian Federation for utility model No. 96283, publ. 20 Jul. 2010), comprising a coolant circulation circuit including a steam generator connected by inlet and outlet pipelines to a heat exchanger located inside a tank with a coolant inventory installed above the steam generator, wherein, a start-up device, which comprises two start-up valves of different flow areas, is installed on the heat exchanger outlet pipeline.

The closest analogue to the claimed system is an emergency cooling system (patent of the Russia Federation for utility model No. 111336, publ. 10 Dec. 2011) comprising steam and water legs, a combined heat exchanger-condenser, a once-through-type steam generator, a water inventory tank, a water inventory tank cistern for emergency cooling, wherein a partition plate is installed in the water inventory tank for emergency cooling, dividing it into two sections, each of which is connected to the atmosphere in the upper part above the water level, and the sections are interconnected by holes in the partition plate, located under the water level.

During the operation of the above systems, a method for bringing a nuclear power plant into a safe state under extreme effect is implemented.

In particular, in the system of gas removal from the main circulation pump of the water-water reactor facility (patent of the Russian Federation for the invention No. 2107344, publ. 20 Mar. 1998), a method for bringing a nuclear power plant into a safe state is implemented, which includes feeding a steam gas mixture from the upper part of the main circulation pump through the gas removal pipelines to the steam space of the pressure compensator, and from the "cold" vertical collecting header through gas removal pipeline 11 to the steam space of the pressure compensator due to hydrostatic pressure in it. In this case, steam-gas seals do not appear in the circuit, and the natural circulation does not break.

In the system for emergency heat removal (patent of the Russian Federation for the invention No. 2646859, publ. 19 Feb. 2018), non-condensable gases contained in the pipelines of the raiser leg, collectors and the pipe system of the heat exchanger-cooler are compressed by steam coining from the heat exchanger-heater, and concentrated in the lower part of the circuit as a heavier substance and squeezed into a tank for collecting non-condensable gases.

In the system of passive heat removal through a steam generator (patent of the Russian Federation for utility model No. 96283, publ. 20 Jul. 2010), in the event of an emergency, the heat of a nuclear reactor is removed through a steam generator through one or more heat exchangers. In this case, according to the appropriate signals, the system is automatically started by opening one of the two valves of the start-up device, after which the natural circulation is established in the SG SPHR circuit. Heat is transferred from the steam generator to the tank water when the steam stream is condensed in the sections of the heat exchanger; the condensate formed is fed back to the steam generator through the outlet pipeline; and when the heat energy comes from the SG SPHR circuit, the water in the tank is heated and boiled, and the resulting secondary steam is removed to environment.

The closest analogue to the claimed method is the method that is implemented during the operation of the emergency cooling system with a combined heat exchanger (patent of the Russian Federation for utility model No. 111 336, publ. 10 Dec. 2011), wherein, in case of emergency, the steam generator is disconnected from the secondary system of the nuclear power plant by isolation valves, then by opening another isolating valve, the water leg of the system is connected to it, water is fed through the water leg of the intermediate circuit, heat is removed through the heat exchanger-condenser to the water stored in a storage tank cistern, heating and evaporating it, and after draining the storage tank cistern, heat is removed to atmospheric air.

The disadvantage of the above systems and methods of cooling is the impossibility of using them to cool the nuclear reactor to a temperature below the boiling point due to the fact that all heat transfer processes in such systems are carried out due to boiling and condensation of the coolant. In addition, in such systems, the relative position of the steam generator and the heat exchanger is critical, if the heat exchanger is located below the steam generator, it becomes difficult to organize the movement of the coolant even with the pump, since the presence of steam in the coolant in this case leads to the formation of air blockages and, as a result, can lead to hydraulic impact.

The object of this group of inventions is to create a method and system for bringing an NPP into a safe state after extreme effect, allowing cooling of the coolant of the NPP to a temperature below the boiling point while eliminating the possibility of hydraulic impact in the system due to the separation of steam and water.

The technical result of the group of inventions is to increase the safety of operation of NPPs under extreme effects by providing the ability to reduce the temperature of the coolant below the boiling point while eliminating the possibility of hydraulic impact in the system due to the separation of steam and water.

The technical result is achieved by the fact that in the known system for bringing a nuclear power plant into a safe state after extreme effect, including inlet and outlet pipelines, a steam generator, a storage tank and a heat exchanger, they further introduce a separation tank located above the steam generator and connected by two pipelines to a storage tank, a pump and a control unit, wherein the heat exchanger is installed in the outlet pipeline, the first water valve is installed in the inlet pipeline, and the separation tank is connected with a storage tank by a pipeline with a second water valve installed in it and a pipeline with a first air valve installed in it.

It is preferable to use a deaerator configured to remove steam from the system as a storage tank.

It is rational to equip the storage tank with a make-up pipeline connected to an external coolant source.

It is recommended that the steam generator be equipped with a vertical steam discharge pipeline with a second air valve installed in it.

It is preferable to equip the system with several steam generators connected to the inlet and outlet pipelines and installed parallel to each other.

It is rational to make at least a part of the inlet pipeline atilt with a slope upward towards the separation tank.

The technical result is also achieved by the fact that in the known method of bringing a nuclear power plant into a safe state after an extreme effect, using a system comprising a steam generator, inlet and outlet pipelines, a storage tank and a heat exchanger, they further include a pump for feeding a coolant and subsequent operation of the system, support the system pressure with monitoring to ensure that the coolant does not boil, install a separation tank above the steam generator, and before feeding the coolant to the storage tank, it is first fed to the separation tank.

It is rational to use water as a coolant.

It is preferable to feed the coolant to the storage tank from an external source.

It is recommended to use the feedwater make-up tank of the NPP as an external source.

It is rational to maintain a constant level in the storage tank and separation tank.

It is preferable to open the first and second air valves when the pressure in the system increases above the level of 0.27 MPa until the pressure drops below the specified level.

It is recommended that the heating of the pipelines to a temperature of 120-140 degrees is performed before feeding the coolant.

It is rational to open the first and second air valves when the steam pressure drops to 98 kPa.

BRIEF DESCRIPTION OF THE DRAWING FIGURE

FIG. 1 shows a system for bringing a nuclear power plant into a safe state after extreme effect.

The system for bringing a nuclear power plant into a safe state after an extreme effect consists of steam generator 1, second air valve 2 connected to it through a steam discharge pipeline, inlet pipeline 3 with first water valve 5 installed in it, connecting steam generator 1 to separation tank 4, which is connected to storage tank 8 through the two pipelines with second water valve 6 and first air valve 7 installed in them, the storage tank is connected to steam generator 1 through outlet pipeline 9, wherein pump 10, heat exchanger 11 and third water valve 12 are installed. In a preferred embodiment, the storage tank is connected by a pipeline to the feedwater make-up tank (not shown in the FIGURE).

PREFERRED EMBODIMENT OF THE INVENTION

A system for bringing a nuclear power plant into a safe state after extreme effect in the preferred embodiment works as follows. After using passive heat removal systems, for example, SG SPHR, or other heat removal systems, the coolant temperature of the NPP will be reduced to 130° C., the system control unit opens the valve between storage tank 8 and the feedwater make-up pipeline, thereby letting feedwater make-up having a temperature of about 25° C. into storage tank 8 to a certain level; it opens third water valve 12 and closes first water valve 5, turns on pump 10, maintains a certain water level in steam generator 1 (about 3.7 in), performs heating of inlet pipeline 3 and outlet pipeline 8, wherein a pressure in the system is maintained at about 0.27 MPa through second air valve 2. Then, when the temperature of the wall of separation tank 4 is reached the value of 125° C., the control unit opens first water valve 5 and sets it in the mode of maintaining a constant liquid flow rate (about 7.5 kg/s per steam generator 1 when using four steam generators 1 in the system). Thereafter, the first air valve 7 is opened, which, similarly to second air valve 2, starts to work in the mode of maintaining the pressure at a level of about 0.27 MPa, and when separation tank 4 reaches a certain level, second water valve 6 starts to work in the mode of maintaining the liquid level. Maintaining the specified steam pressure in the system is required in order to avoid boiling of saturated water in the steam generator when the pressure decreases. Then, after the flooding of steam generator 1 and pipelines, third water valve 12 can be switched to the mode of maintaining increased liquid flow (up to 12.5 kg/s, up to 50 kg/s for a total of four steam generators). Then, the reactor is cooled down to a temperature of 70° C., which can take several days. Upon reaching a temperature of 70° C., a passive heat removal system ensures the removal of residual heat during all the time necessary for this, which can be up to 60 days. In this case, in the preferred embodiment, when the pressure in the system is lower than 98 kPa, first 7 and second 2 air valves are opened to their full section area and turned off from the pressure maintenance mode in the system, wherein there is no longer any danger of the coolant boiling up in steam generator 1 at that moment and there is no need in pressure regulation, and atmospheric pressure is sufficient for the most efficient heat exchange process. All of the above processes are controlled by a control unit (not shown in the FIGURE).

In a preferred embodiment of the group of inventions, a deaerator is used as storage tank 8, and the piping system of the secondary system of the NPP with WWER already used in normal operation of the NPP as inlet 3 and outlet 9 pipelines, wherein the deaerator is located below the steam generator, and inlet pipeline 3 in the systems currently used in NPPs with WWER is located with a decrease from steam generator 1 towards the deaerator, which is rational for the normal operation of the secondary system of NPPs with WWER, since it allows the collection of moisture after the passage of steam through this section at its lower point and to remove it to the drainage system so as to avoid its feed to the NPP turbine. This solution allows to use the systems already existing in the secondary system of the NPP to bring the NPP to a safe state, however, in the emergency operation mode of the inventive system, not steam passes through steam pipeline 3, but the steam-water mixture and therefore the reduction of inlet pipeline 3 creates the conditions for the occurrence of steam blockages in pipeline 3, as a result, hydraulic impacts. That is why separation tank 4, located above steam generator 1, is added to the system, and at least a part of inlet pipeline 3 is placed with a slope upward towards separation tank 4. This solution avoids the accumulation of steam blockages. In addition, in order to remove excess steam from steam generator 1, a vertical steam discharge pipeline with second air valve 2, configured to relieve steam pressure when the pressure exceeds 0.27 MPa, is additionally introduced into the system in the preferable embodiment, since lower pressure can lead to boiling water and therefore poses a threat to the integrity of the piping of the system. The steam discharge pipeline can be made wide enough, up to 3 meters in diameter, in order to avoid turbulent effects during steam removal.

The use of a deaerator as storage tank 8 also makes it possible to use its blowdown system to remove steam from the system. In addition, it is also rational to use other standard secondary systems of WWER NPPs. In particular, in a preferred embodiment of the claimed group of inventions, the standard feedwater make-up system of NPPs is used as an external source of feedwater make-up, the standard secondary system pump of an NPP with WWER is used as a pump, and the standard cooling system of non-critical consumers of NPPs is used as heat exchanger 11.

When supplying feed water to the system, its flow rate can be chosen so that the process of filling steam generator 1 and pipelines 3 and 9 occurs with saturated water. Due to this, it is possible to avoid condensation hydraulic impact arising from the meeting of steam with a cold liquid. One of the main conditions for the occurrence of condensation hydraulic impact is the underheating of water relative to steam, the critical values of which are 15° C. and above. The most likely section wherein condensation hydraulic impact can occur during filling is the steam collecting header of steam generator 1. As calculations showed, when filling the system, it is rational to maintain water at a temperature close to the saturation temperature and reduce it only after pipelines 3 and 9 are completely filled.

Calculations carried out using software have shown that when using four steam generators connected to the inventive system in parallel, using water from the feed system and the cooling system for non-critical consumers, it is possible to cool the NPP from 130° C. to 70° C. without causing hydraulic impact for 60 hours. In addition, the calculations showed that even in the event of failure of one of the steam generators, cooling the system using three steam generators according to the proposed method and system is quite safe and allows to bring the NPP to a safe state at a temperature of 70° C.

INDUSTRIAL APPLICABILITY

The method and system for bringing a nuclear power plant into a safe state after an extreme effect can be applied in nuclear power plants with water-water energetic reactor to bring them to a safe state after an extreme effect.

The invention claimed is:

1. A system for bringing a nuclear power plant into a safe state after extreme effect, the system comprising:

a steam generator;

a separation tank;

a storage tank;

a pump;

a heat exchanger;

a control unit configured to control the system;

a first water valve;

a second water valve;

a first air valve;

an inlet pipeline from the steam generator to the separation tank;

two pipelines comprising a first pipeline and a second pipeline, the first pipeline configured to provide a path for water in the separation tank to be transferred to the storage tank, the second pipeline configured to provide a path for gas in the separation tank to be transferred to the storage tank;

a discharge pipeline from the storage tank to the pump; and an outlet pipeline from the storage tank to the pump and from the pump to the steam generator;

the separation tank located above the steam generator and connected by the two pipelines to the storage tank; and wherein the heat exchanger is installed in the outlet pipeline downstream of the pump, the first water valve is installed in the inlet pipeline, and the separation tank is connected with the storage tank by the first pipeline with the second water valve installed therein and the second pipeline with the first air valve installed therein.

2. The system according to claim 1, wherein a deaerator configured to remove steam from the system is used as the storage tank.

3. The system according to claim 1, wherein the system comprises a vertical steam discharge pipeline with a second air valve; and the steam generator is equipped with the vertical steam discharge pipeline with the second air valve.

4. The system according to claim 1, wherein the system comprises a plurality of steam generators connected in parallel to each other to the inlet and outlet pipelines.

5. The system according to claim 1, wherein at least a part of the inlet pipeline is configured to have an upward slope towards the separation tank.

* * * * *